US008777240B2

(12) United States Patent
Edginton

(10) Patent No.: US 8,777,240 B2
(45) Date of Patent: Jul. 15, 2014

(54) WHEELED SPORT APPARATUS, AS FOR TRAINING AND RECREATION

(71) Applicant: Powdr-Woodward PA LLC, Park City, UT (US)

(72) Inventor: William Eric Edginton, Rigby, ID (US)

(73) Assignee: Powdr-Woodward PA LLC, Park City, UT (US)

( * ) Notice: Subject to any disclaimer, the term of this patent is extended or adjusted under 35 U.S.C. 154(b) by 0 days.

(21) Appl. No.: 13/769,671

(22) Filed: Feb. 18, 2013

(65) Prior Publication Data

US 2013/0154221 A1 Jun. 20, 2013

Related U.S. Application Data

(63) Continuation of application No. 12/573,945, filed on Oct. 6, 2009, now Pat. No. 8,398,099.

(60) Provisional application No. 61/103,339, filed on Oct. 7, 2008.

(51) Int. Cl.
*B62M 1/00* (2010.01)

(52) U.S. Cl.
USPC ..... 280/87.042; 280/841

(58) Field of Classification Search
USPC ..... 280/8–10, 11.19, 87.01, 87.041, 280/87.042, 87.043, 87.05
See application file for complete search history.

(56) References Cited

U.S. PATENT DOCUMENTS 1,100,322 A * 6/1914 O'Day ..... 105/162
1,123,686 A * 1/1915 Cole et al. ..... 280/87.042
2,077,274 A 4/1937 Silkman
2,487,297 A 11/1949 Berman
3,827,706 A 8/1974 Milliman
3,891,225 A 6/1975 Sessa
4,073,356 A * 2/1978 Schlicht ..... 180/181
4,106,786 A 8/1978 Talbott
4,700,958 A 10/1987 Volpato
4,744,576 A 5/1988 Scollan, Jr.
4,795,181 A * 1/1989 Armstrong ..... 280/87.042
4,887,824 A 12/1989 Zatlin
5,046,747 A 9/1991 Nielsen, Jr.
5,096,225 A 3/1992 Osawa
5,125,687 A 6/1992 Hwang
5,195,781 A 3/1993 Osawa
5,409,265 A 4/1995 Douglass (Continued)

FOREIGN PATENT DOCUMENTS

FR 2554772 5/1985

OTHER PUBLICATIONS

Notice of Allowance dated Jan. 17, 2013 in U.S. Appl. No. 12/573,945.
Office Action dated Dec. 5, 2012 in U.S. Appl. No. 12/573,945.

(Continued)

*Primary Examiner* — J. Allen Shriver, II
*Assistant Examiner* — Bridget Avery
(74) *Attorney, Agent, or Firm* — Snell & Wilmer L.L.P.

(57) ABSTRACT

A wheeled sport apparatus may comprise a platform and first and second sets of wheels disposed on the platform. Each set of wheels may include a center wheel between two outboard wheels and the outboard wheels may be toed outward for defining a turning radius. One or more carrier wheels may be provided between the first and second sets of wheels.

25 Claims, 6 Drawing Sheets

(56) References Cited

U.S. PATENT DOCUMENTS

| | | | | |
|---|---|---|---|---|
| 5,553,874 | A | 9/1996 | Schouten et al. | |
| 5,673,941 | A | 10/1997 | Osawa | |
| 5,707,068 | A | 1/1998 | Bradfield | |
| 5,855,385 | A | 1/1999 | Hambsch | |
| 5,868,408 | A | 2/1999 | Miller | |
| 6,237,960 | B1 | 5/2001 | Dornhofer | |
| 6,435,558 | B2 | 8/2002 | Osawa | |
| 7,172,205 | B1 * | 2/2007 | Vujtech | 280/87.021 |
| 8,246,070 | B2 * | 8/2012 | Lin | 280/602 |
| 2002/0153686 | A1 * | 10/2002 | Todd | 280/87.042 |
| 2008/0029985 | A1 | 2/2008 | Chen | |
| 2009/0115152 | A1 * | 5/2009 | Wilson | 280/87.042 |
| 2009/0256325 | A1 | 10/2009 | Dickie | |

OTHER PUBLICATIONS

Restriction Requirement dated Aug. 1, 2012 in U.S. Appl. No. 12/573,945.

Mance, Joel, "Snowboard on Wheels", YouTube, http://www.youtube.com/watch?v=jzc1ie9g-3a&feature=related, Feb. 19, 2008, 2 pages.

Coogle, "Picture of Snowboard with Wheels", Google Image Search, printed Sep. 23, 2009, 3 pages.

Super Dairy Boy, "Tierney Hides "T" Board Carve on 2 Wheels instead of 4", http://www.superdairyboy.com/recreational%20items/tierney__rides/t__board.html, (C) 2001-2008, 5 pages.

* cited by examiner 110
140
150
130
132
113
116
114
111
120
122
124
112

100'
110'
102
111
112
116
120
121
122
124
126
130
132
136
150
A

WHEELED SPORT APPARATUS, AS FOR TRAINING AND RECREATION

This application is a continuation of and claims the benefit of U.S. patent application Ser. No. 12/573,945 filed Oct. 6, 2009 titled "WHEELED SPORT APPARATUS, AS FOR TRAINING AND RECREATION," which is a non-provisional U.S. Provisional Patent Application No. 61/103,339 filed on Oct. 7, 2008 and titled "WHEELED SPORT APPARATUS, AS FOR TRAINING AND RECREATION," both of which are hereby incorporated herein by reference in their entireties.

The present invention relates to sport apparatus and, in particular, to wheeled sport apparatus.

Often, sport apparatus is useful only with certain conditions and/or environments. For example, winter sport apparatus, such as skis and snowboards, are normally used on snow covered slopes, courses, jumps, ramps, and the like. The problem is that without snow the apparatus is not used. An early partial solution to that dilemma was to develop equipment that artificially made snow that could be distributed over a surface on which the skis and/or snowboards could then be used. But that was only a solution in cold weather seasons and locales where conditions for making artificial snow were present.

Another development was to provide such apparatus with wheels that are mounted beneath the bottom surface of the ski or snowboard so that it would roll along on a hard surface not covered with snow, thereby allowing one to simulate skiing or snowboarding when there is no snow, much like a skateboard does. Such arrangements, however, do not provide a close simulation of skiing or snowboarding on snow.

One example of such is the wheeled board apparatus described in U.S. Pat. No. 5,855,385 wherein two primary wheels are provided along a central longitudinal axis of a platform and three outrigger wheels are located generally along each of two concave side edges of the platform. Such wheeled board apparatus falls short in that flexing of the platform when turning causes the touching down of the outrigger wheels to be inconsistent and uncertain, and so it can provide inconsistent and uncertain turning that does not correspond to what a rider would experience riding a snowboard on snow, nor is the platform close to ground level as it would be for a snowboard on snow.

Accordingly, there is a need for a wheeled sport apparatus that can more closely mimic the ride and feel of an actual sport apparatus on the natural surface on which it is used, e.g., that of a snowboard or skis on snow.

To this end, wheeled sport apparatus may comprise: a platform and first and second sets of wheels disposed on the platform. Each set of wheels may include a center wheel between two outboard wheels, and the outboard wheels may be toed outward for defining a turning radius.

BRIEF DESCRIPTION OF THE DRAWING

The detailed description of the preferred embodiment(s) will be more easily and better understood when read in conjunction with the FIGURES of the Drawing which include.

Figure 1:
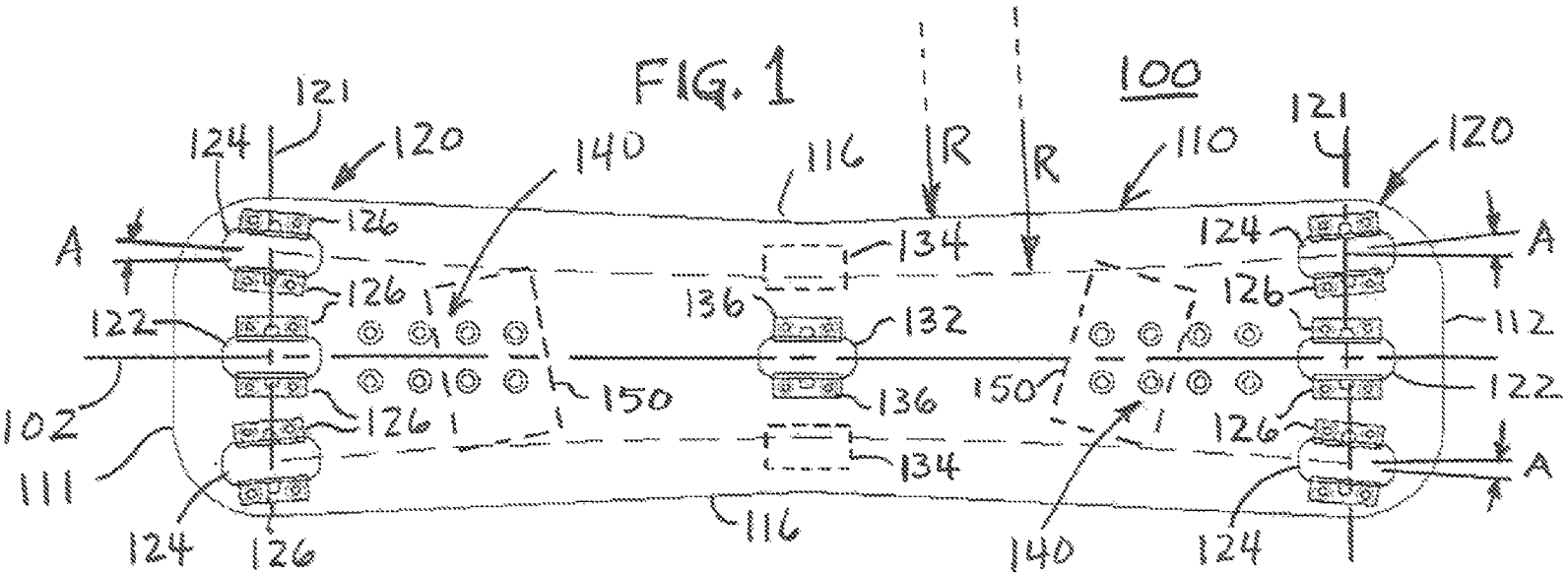
FIG. 1 is a schematic diagram top view of an example embodiment of a wheeled sport apparatus in a shape simulating a snowboard.

In the Drawing, where an element or feature is shown in more than one drawing figure, the same alphanumeric designation may be used to designate such element or feature in each figure, and where a closely related or modified element is shown in a figure, the same alphanumerical designation primed or the like may be used to designate the modified element or feature. Similarly, similar elements or features may be designated by like alphanumeric designations in different figures of the Drawing and with similar nomenclature in the specification. It is noted that, according to common practice, the various features of the drawing are not to scale, and the dimensions of the various features are arbitrarily expanded or reduced for clarity, and any value stated is given by way of example only.

DESCRIPTION OF THE PREFERRED EMBODIMENT(S)

The wheeled sport apparatus herein is intended to closely simulate the ride and feel of a snowboard on snow or of skis on snow. To this end, wheel sets 120 are provided at opposite ends 111, 112 of platform (deck) 110, 110' in a shape and size evocative of a snowboard or of a ski, as may be desired. The wheels of wheel sets 120 are mounted in openings in platform 100, 100', 100", 100'" with parts of the wheels thereof above platform 110, 110', 110", 110'" and parts of the wheels below platform 110, 110', 110", 110'" so that platform 110, 110', 110", 110'" rides closer to a riding surface, thereby to be more like a snowboard on snow or a ski on snow.

It may be thought desirable that the wheeled sport apparatus be simple, be similar in ride and appearance to a snow board or a ski, as the case may be, ride similarly to a snowboard or ski, as the case may be, accommodate standard snowboard and ski bindings, and be able to negotiate small imperfections in the riding surface without upsetting the rider. It would also be desirable that the apparatus be durable, e.g., so as to survive impact and use without failure, and be able to be constructed of commonly available materials, e.g., of the sorts of materials commonly employed in making snowboards and skis.

Figure 2:
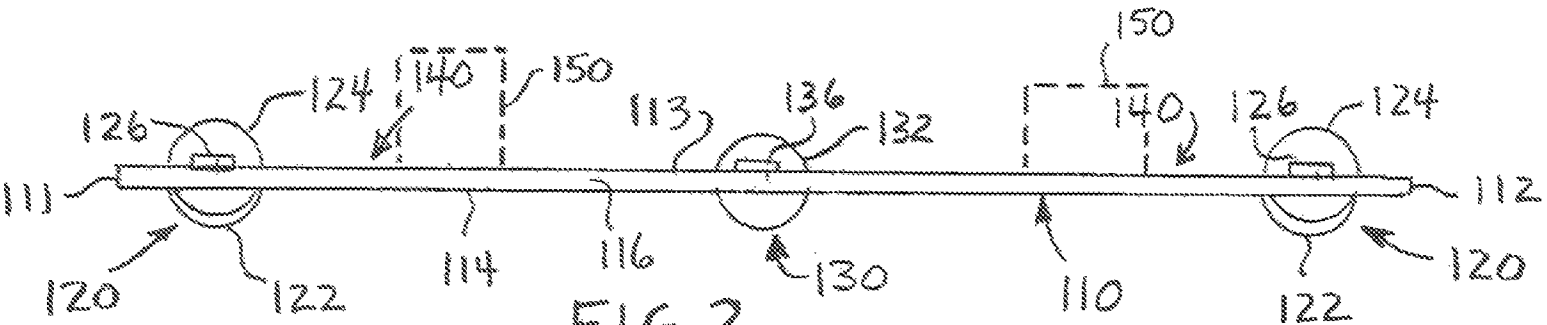
FIG. 2 is a schematic diagram side view of the example embodiment of a wheeled sport apparatus in a shape simulating a snowboard.

FIG. 1 is a schematic diagram top view and FIG. 2 is a schematic diagram side view of an example embodiment of a wheeled sport apparatus 100 in a shape simulating a snow board. Apparatus 100 is in a shape and size similar to that of a snowboard, and so may typically have a length of about 0.75-2 meters and a width of about 15-35 centimeters, and its platform 110 would typically be about 10-25 millimeters thick.

Wheeled apparatus 100 comprises a platform 110 having a longitudinal axis 102 in a direction along which apparatus 100 travels or rolls, having first and second ends 111, 112, having a top or riding surface 113 and a bottom surface 114, and having side edges 116. Platform 110 includes a first wheel set 120 including three wheels 122, 124 disposed generally near a transverse line 121 near first end I11 thereof and a second wheel set 120 including three wheels 122, 124 disposed generally near a second transverse line 121 near second end 112 thereof, all of which are aligned to roll in a direction generally parallel to longitudinal axis 102, e.g., in a typical direction of travel.

Wheeled apparatus 100 may also include an optional carrier wheel or support Wheel 130 which may include a single wheel 132, or a pair of wheels 134, or three wheels 132, 134, all of which are aligned to roll in a direction generally parallel to longitudinal axis 102, e.g., in a typical direction of travel. Apparatus 100 may have no carrier wheel, e.g., in view of the relatively short and wide snow board-like shape of platform 100. Carrier wheel 130 serves to provide support near the central region of platform 110 for bearing the weight of a rider and the impact forces associated with landing and riding of apparatus 100.

Each of wheels 122, 124 is attached to platform 110 and positioned in a respective opening in platform 110 by wheel mounting brackets 126 which may be attached to platform 100 by any convenient means, e.g., by bolts or screws, by rivets, by adhesive and/or by being molded into platform 110, or by arc, spot or gas welding. Similarly, each of optional carrier wheels 132, 134, if any, is attached to platform 120 and positioned in a respective opening in platform 110 by wheel mounting brackets 136 which may be attached to platform 100 by any convenient means, typically the same means as is utilized for mounting brackets 126. Mounting brackets 126, 136 at opposite sides of the openings in which wheels 122, 124, 132 and/or 134 are positioned to receive the opposite ends of the axles of wheels 122, 124, 132, and/or 134 for positioning wheels 122, 124, 132 and/or 134 in a desired predetermined elevation relative to platform 100. The openings in platform 100 are preferably slightly larger than the dimensions of wheels 122, 124, 132, 134 so as to provide clearance for allowing those wheels to freely rotate.

Wheeled apparatus 100 also preferably includes mounting provisions 140 for receiving a foot retaining device 150 such as a snowboard binding. Typically, snowboard bindings 150 have industry standard mounting configurations and spacings, and may be rotated and fixed at a desired angle once mounted, and so platform 110 includes a plurality of threaded inserts 140 embedded therein For example, eight threaded inserts 140 may be spaced apart in two parallel lines at standard spacings for receiving bindings in three different longitudinal positions, or ten threaded inserts 140 may be spaced apart in two parallel lines at standard spacings for receiving bindings in four different longitudinal positions, or twelve threaded inserts 140 may be spaced apart in two parallel lines at standard spacings for receiving bindings in five different longitudinal positions, or another number of inserts 140 may be provided, whereby a rider may locate forward and rearward bindings independently and at personally preferred positions, and may independently rotate each binding to desired respective angles relative to longitudinal axis 102.

The locations and positions of wheel sets 120 and of wheels 122, 124 thereof with respect to platform 110 are particularly selected to provide the desired riding characteristics for wheeled apparatus 100, e.g., a snowboard simulating wheeled apparatus 100. This includes both the degree or extent to which particular wheels extend from platform 110 and the angles at which particular wheels are positioned with respect to longitudinal axis 102. In general center wheels 122 extend further from bottom surface 114 of platform 110 than do outboard wheels 124 so that apparatus 100 can roll relatively straightly forward or backward on center wheels 122, and outboard wheels 124 are canted outward at an angle A, or toed out, for providing a desired turning radius R.

Wheels 124 of wheel set 120 cooperate with wheels 122 thereof for allowing platform 110 to be tilted to the right or to the left and are oriented at a toed-out angle A for providing turning and for defining an arc of a circle having a predetermined diameter R that is a predetermined turning radius R or wheeled board 100. Wheels canted at the angle A are considered herein to be generally parallel to longitudinal axis 102. Angle A of outboard wheels 124 is measured relative to the direction of center wheels 122, or relative to longitudinal axis 102, and is selected for providing a desired turning radius R, e.g., about five meters. Board 100 will turn towards the left when platform 110 leans to the left so that the outboard wheels 124 that are proximate the left side edge 116 touch the riding surface and will turn towards the right when platform 110 leans to the right so that the outboard wheels 124 that are proximate the right side edge 116 touch the riding surface. When the left hand side or right hand side outboard wheels 124 touch the riding surface, they define by their angles A an arc of a circle to which their respective rolling directions are tangential and the radius of that circle defines the desired turning radius R. Typically, turning radius R could be in the range of about 4-15 meters as maybe desirable for a snowboard simulating apparatus 100.

So that apparatus 100 will ride on center wheels 122 when level and traveling in a forward or a rearward direction, e.g., traveling in the direction of longitudinal axis 102, without outboard wheels 124 contacting the riding surface, center wheels 122 extend further from bottom surface 114 of platform 110 than do outboard wheels 124. Where all of wheels 122, 124 are of the same diameter, the axles of wheels 122 are located closer to platform 110 and the axles of wheels 124 are located above platform 110, so that center wheel 122 extends further from the bottom surface 114 of platform 110 than do outboard wheels 124, while wheels 122, 124 also extend above the top surface 113 of platform 100, as described more specifically in relation to FIG. 3.

Alternatively, a center wheel 122 having a greater diameter may be employed in cooperation with outboard wheels 124 having a lesser diameter, as where, e.g., center wheels 122 have a diameter of about 72 mm and outboard wheels 124 have a diameter of about 70 mm, and where the axles of wheels 122, 124 are at substantially the same location relative to platform 110.

An advantage arises from this arrangement because platform 110 is closer to the riding surface than is the case with conventional wheeled boards wherein the wheels are located below the platform causing the wheeled board to ride further from the riding surface. Thus, apparatus 100 provides riding characteristics that tend to more closely simulate riding a snowboard on snow.

Typically all of wheels 122, 124, and wheels 132, 134, if any, of snowboard apparatus 100 maybe of the same diameter and material. Preferably wheels 122, 124, 132, 134 may be urethane, rubber, ABS plastic, composite, ceramic, or metal wheels riding on ball or roller bearings for rotation about their respective axles, although common commercially available urethane or other industry standard wheels may offer an advantage in cost and/or availability. In one typical embodiment of snowboard-like apparatus 100, wheels 122, 124, 132, 134 are about 76 mm in diameter and about 24 mm in width.

Also typically, platform 110 may be made of any material commonly utilized for snowboards, e.g., wood, fiberglass reinforced resin, plastic, laminated wood, fiberglass laminated with foam or aluminum, or any other suitable material or laminate, or any combination thereof, and may have a typical snow board like shape. In one typical embodiment, a fiberglass reinforced resin platform 110 is about 1.0 meter long and about 22 centimeters wide, and about 1.0 em thick. Therein, wheel sets 120 are located about 0.44 meter away from the center of the longitudinal direction of platform 110 (e.g., about 0.06 meter from ends I11, 112), and outboard wheels 124 are toed out at an angle A of about Y for providing a turning radius of about five meters, and are positioned vertically relative to center wheel 122 for providing a distance of about 2.4 mm between wheel 124 and the riding surface.

Side edges 116 may be generally straight as they typically are in a snow board for use on snow, noting that a snowboard used on snow turns on its edges and so the shape of its edges is important to its riding characteristics. In snowboard-like wheeled apparatus 100, turning is provided by wheels 124 and so side edges 116 may be straight or concave or convex for giving a desired appearance, although it is thought to be preferred to make side edges 116 curved at about turning radius R so as to reduce the likelihood of a side edge 116 contacting the riding surface in a sharp turn.

An advantage in riding stability appears to arise because the wheels 122, 124 of wheel sets 120 in the described apparatus lie substantially along the same or close to the same transverse line 121, in that tipping up one end 111, 112 of apparatus 100 at an angle with respect to a riding surface tends to more closely maintain the relative contact of the wheels 122, 124 of the wheel set that remains in contact with the riding surface than would be the case if center wheel 122 were to be substantially longitudinally offset from the line of outboard wheels 124. That being said, however, center wheel 122 may be located slightly closer to an end 111, 112 than are outboard wheels 124, or may be located slightly farther from an end 111, 112 than are outboard wheels 124, e.g., within about one wheel diameter or less, without materially reducing this advantage, and wheels so located are considered herein to be mounted generally along transverse line 121, e.g., a line that is substantially perpendicular to longitudinal axis 102 of platform 110 and apparatus 100.

Figure 3:
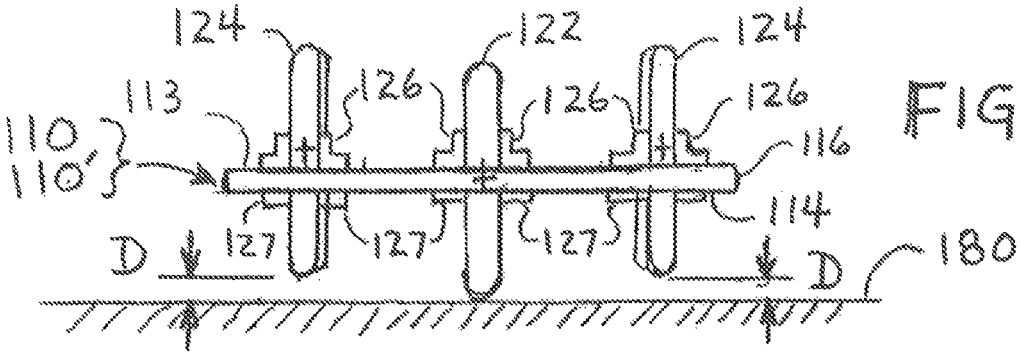
FIG. 3 is a schematic diagram end view of an example embodiment of a wheeled sport apparatus.

FIG. 3 is a schematic diagram end view of an example embodiment of a wheeled sport apparatus 100 that illustrates the relative positions of wheels 122 and 124 of wheel set 120 relative to platform 110 for providing in cooperation with the angle A at which outboard wheels 124 are mounted on platform 110. It is noted that the arrangement of wheels 122, 124 of FIG. 3 is representative of both the wheeled sport apparatus 100 that is in a shape simulating a snowboard as described above and of a wheeled sport apparatus 100' in a shape simulating a ski as described below, and of other apparatus in accordance with the described arrangement.

Example wheeled apparatus 100 is illustrated in a generally level orientation as it would be in when traveling in a generally straight line in a general direction along longitudinal axis 102. Therein axle of center wheel 122 is mounted between two brackets 126 with the central axis, e.g., the axis of rotation, of wheel 122 located above the bottom surface 114 of platform 110, as indicated by the + sign within the outline of center wheel 122. As a result, about half, or perhaps more than half, of center wheel 122 extends above top surface 113 of platform 110 and less than half of center wheel 122 extends below the bottom surface 114 of platform 110. In one example embodiment, the axis of wheel 122 is located at about the top surface 113 of platform 110 and may be located between the top and bottom surfaces 113, 114 of platform 110.

The axles of outboard wheels 124 are mounted between two brackets 126 with the central axis thereof being further above the bottom surface 114 of platform 110 by an amount greater than that of center wheel 122, as indicated by the + signs within the outlines of outboard wheels 124. As a result, more than half of outboard wheels 124 extends above top surface 113 of platform 110 and less than half of outboard wheels 124 extends below the bottom surface 114 of platform 110, whereby the periphery of outboard wheels 124 are spaced away from riding surface 180 by a distance D when wheeled apparatus 100 is level, e.g., when platform 110 is parallel to riding surface 180. Distance D may be a distance determined by where the respective axles of outboard wheels 124 are mounted relative to the axles of center wheel 122 where wheels 122, 124 are of the same diameter, or may be determined by half the difference in the respective diameters of wheels 122, 124 where wheel 122 has a greater diameter than do wheels 124 and their respective axles are co-planar, or may be determined by a combination thereof. In one example embodiment employing 76 mm diameter wheels, the axis of rotation of outboard wheels 124 is located above the top surface 113 of platform 110.

In one embodiment of a snowboard-like wheeled apparatus 100 wherein wheels 122 and 124 have a diameter of about 72 mm, distance D is about 2.5 mm, which is a dimension that in cooperation with the other dimensions of the snowboard-like wheeled apparatus 100 provides a turning radius R of about five meters.

Wheel mounting brackets 126 may be provided by an angled bracket 126, e.g., an aluminum or other metal bracket, adjacent the top surface 113 of platform 110 and may be secured thereto by bolts and nuts (not shown) through platform 110. Optionally, a washer or plate 127 may be provided adjacent the bottom surface 114 of platform 110 opposite bracket 126 for providing reinforcement. Alternatively, brackets 126 may be secured to top surface 113 of platform 110 by bolts or screws engaging threaded inserts that are embedded in platform 110, similarly to the binding mounting inserts 140, or brackets 126 may have a base that may be molded and/or otherwise embedded into platform 110.

Figure 4:
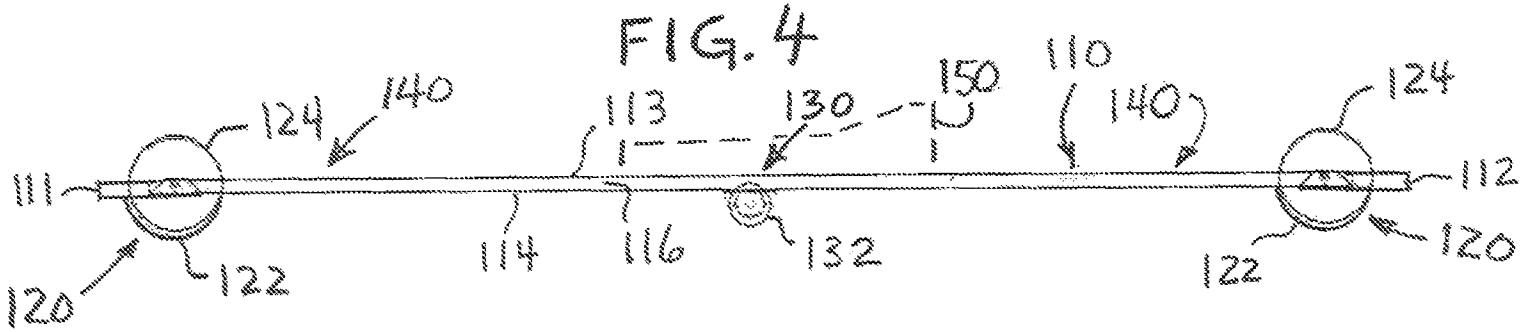
FIG. 4 is a schematic diagram top view of an example embodiment of a wheeled sport apparatus in a shape simulating skis.
Figure 5:
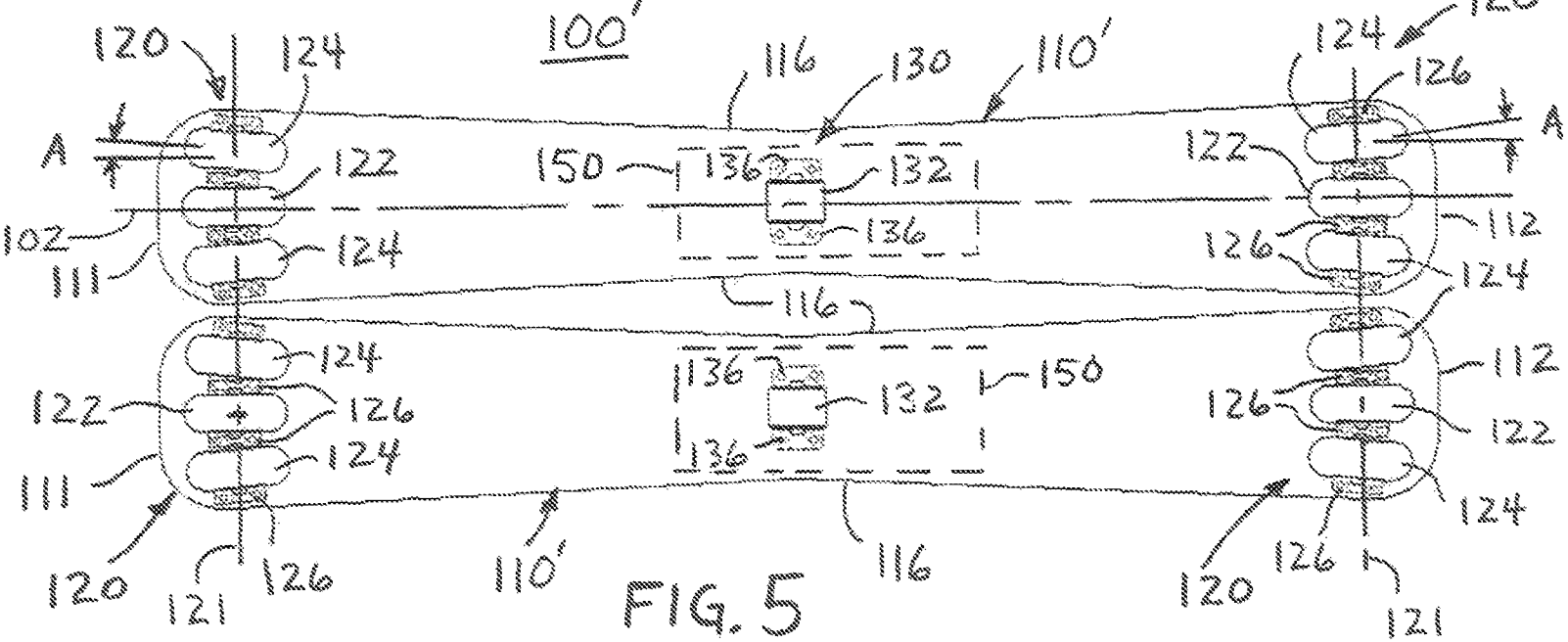
FIG. 5 is a schematic diagram side view of the example embodiment of a wheeled sport apparatus in a shape simulating a ski.

FIG. 4 is a schematic diagram top view and FIG. 5 is a schematic diagram side view of an example embodiment of a wheeled sport apparatus 100' in a shape simulating skis. Ski-like wheeled apparatus 100' is similar in configuration and function to snow board-like wheeled apparatus 100 except that the shape and size of platform (deck) 110' thereof is longer and narrower so as to be more like the shape and size of a ski. E.g., apparatus 100 may typically have a length of about 1-2.5 meters and a width of about 10-18 centimeters, and would typically be about 10-25 millimeters thick.

Ski-like wheeled apparatus 100' includes features of apparatus 100, in particular apparatus 100' includes wheel sets 120 proximate the opposite ends I11 and 112 of platform 100' with each wheel set 120 having its center wheels 122 and outboard wheels 124 arranged as described above in relation to FIGS. 1, 2 and 3, e.g., for providing a low riding wheeled apparatus 100' that closely mimics the ride of skis on snow.

Wheeled apparatus 100' comprises a ski-like platform 110' having a longitudinal axis 102 in a direction along which apparatus 100' travels or rolls, having first and second ends 111, 112, having a top or riding surface 113 and a bottom surface 114, and having side edges 116. Platform 110' includes a first wheel set 120 including three wheels 122, 124 disposed generally near a transverse line 121 near first end I11 thereof and a second wheel set 120 including three wheels 122, 124 disposed generally near a second transverse line 121 near second end 112 thereof, all of which are aligned to roll in a direction generally parallel to longitudinal axis 102, e.g., in a typical direction of travel.

Wheeled apparatus 100 may also include a carrier wheel or support wheel 130 which may include a single wheel 132, or a pair of wheels, all of which are aligned to roll in a direction generally parallel to longitudinal axis 102, e.g., in a typical direction of travel. While apparatus 100' may have no carrier wheel, it is preferred to provide at least one carrier wheel 132 in view of the relatively long and narrow shape of ski-like platform 110'. Carrier wheel 130 serves to provide support near the central region of platform 110 for bearing the weight of a rider standing in ski-like bindings 150, and the impact forces associated with landing and riding of apparatus 100'.

Each of wheels 122, 124 is attached to platform 110' and positioned in a respective opening in platform 110' similarly to that described above.

Ski-like wheeled apparatus 100' also preferably includes mounting provisions 140 for receiving a foot retaining device 150 such as a ski boot binding. Typically, ski bindings 150 have industry standard mounting configurations and spacings. Platform 110' may optionally include threaded inserts 140, e.g., Helicoil threaded inserts, embedded therein or another mounting arrangement for receiving and securing ski binding 150, although ski bindings are often fastened directly to skis using a screw with a wood-screw type thread.

The locations and positions of wheel sets 120 and of wheels 122, 124 thereof with respect to platform 110' are particularly selected to provide the desired riding characteristics for ski-like wheeled apparatus 100'. This includes both the degree or extent to which particular wheels extend from platform 110 and the angles at which particular wheels are positioned with respect to longitudinal axis 102, e.g., so as to provide a ride that closely mimics the ride of skis on snow. In general, center wheels 122 extend further from bottom surface 114 of platform 110 than do outboard wheels 124 so that apparatus 100' can roll relatively straightly forward or backward on center wheels 122, and outboard wheels 124 are canted outward at an angle A, or toed out, for providing a desired turning radius R.

Wheels 124 of wheel set 120 cooperate with wheels 122 thereof for allowing platform 110' to be tilted to the right or to the left and are oriented at a toed-out angle A for providing turning and for defining an arc of a circle having a predetermined diameter R that is a predetermined turning radius R or wheeled ski 100. Wheels canted at the angle A are considered herein to be generally parallel to longitudinal axis 102. Angle A of outboard wheels 124 is measured relative to the direction of center wheels 122, or relative to longitudinal axis 102, and is selected for providing a desired turning radius R, e.g., about five meters. Wheeled ski 100 will turn towards the left when platform 110' leans to the left so that the outboard wheels 124 that are proximate the left side edge 116 touch the riding surface and will turn towards the right when platform 110' leans to the right so that the outboard wheels 124 that are proximate the right side edge 116 touch the riding surface. When the left hand side or right hand side outboard wheels 124 touch the riding surface, they define by their angles A an arc of a circle to which their respective rolling directions are tangential and the radius of that circle defines the desired turning radius R. Typically, turning radius R could be in the range of about 4-15 meters as may be desirable for a ski-simulating apparatus 100'.

Typically, all of wheels 122, 124 of ski-like apparatus 100' maybe of the same diameter and material, however, support wheel 130, if any, is typically of a smaller diameter so as to be mountable generally centrally to the bottom 114 of platform 110' where it will not interfere with binding 150 which is typically located generally centrally on the top surface 113 of platform 110'. Preferably wheels 122, 124, 132, and/or 134 maybe urethane, rubber, ABS plastic, composite, ceramic, or metal wheels riding on ball or roller bearings for rotation about their respective axles, although common commercially available urethane or other industry standard wheels may offer an advantage in cost and/or availability. In one typical embodiment of ski-like apparatus 100', wheels 122, 124, are about 72 mm in diameter and about 24 mm in width, and wheel 132 is about 34 mm in diameter and about 24 mm in width.

In one embodiment of a ski-like wheeled apparatus 100' wherein wheels 122 and 124 have a diameter of about 72 mm, distance D between platform 110' and riding surface 180 is about 24 mm, and the distance between the periphery of outboard wheels 124 and riding surface 180 is about 2.4 mm, which is a dimension that in cooperation with the other dimensions of the ski-like wheeled apparatus 100' provides a turning radius R of about five meters. In one embodiment of ski-like wheeled apparatus 100' center wheels 122 were located about one wheel diameter closer to ends I11, 112, than were outboard wheels 124, which is considered herein to be generally near to transverse line 121. Center wheel 122 may be located either slightly forward or slightly rearward of outboard wheels 124, e.g., about one wheel diameter or less.

Also typically, ski-like platform 110' may be made of any material commonly utilized for skis, e.g., wood, fiberglass reinforced resin, plastic, laminated wood, fiberglass laminated with foam or aluminum, or any other suitable material or laminate, or any combination thereof, and may have a typical ski-like shape. In one typical embodiment of a ski-like wheeled apparatus 100', a fiberglass reinforced resin platform 110' is about 1.0 meter long and about 15 centimeters wide, and about 1.0 em thick. Therein, wheel sets 120 are located about 0.44 meter away from the center of the longitudinal direction of ski-like platform 110' (e.g., about 0.06 meter from ends 111, 112), and outboard wheels 124 are toed out at an angle A of about Y for providing a turning radius of about five meters, and outboard wheels 124 are positioned for providing a distance D of about 2.4 mm between wheels 124 and the riding surface 180.

Side edges 116 may be generally straight as they typically are in a ski for use on snow, but in ski-like wheeled apparatus 100' may be straight or concave or convex for giving a desired appearance, although it is thought to be preferred to make side edges 116 curved at about turning radius R so as to reduce the likelihood of a side edge 116 contacting the riding surface in a turn.

Figure 6:
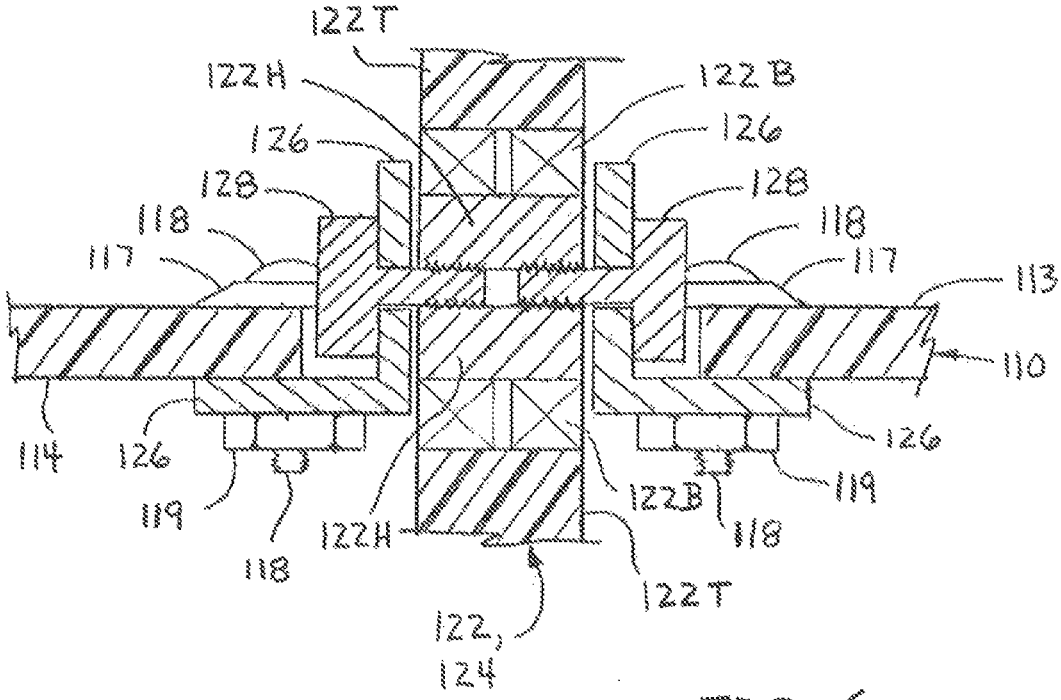
FIG. 6 is a schematic diagram cross-sectional view of an example mounting arrangement for a wheel of a wheeled sport apparatus.

FIG. 6 is a schematic diagram cross-sectional view of an example mounting arrangement 126, etc. for a typical wheel 120, 130 of a wheeled sport apparatus 100, 100', while being described in terms of a typical wheel 122 may be employed for any of wheels 122,124, 132, 134 and the like. Wheel 122 comprises, e.g., in a simplified depiction of typically a standard wheel a wheel hub 122H having a threaded central hole therein for receiving a mounting fastener 128, e.g., screws or bolts 128, therein or therethrough for mounting wheel 122.

Bearings 122B of wheel 122 ride on wheel hub 122H for supporting and allowing free rotation of the wheel tire portion 122T around an axis of rotation that is substantially through the center of hub 122H and the longitudinal axis of fastener 128, e.g., screws 128, and is coaxial therewith.

Wheel 122 is mounted to two opposing mounting brackets 126 each having an "L" shape so as to have one part of the "L" adjacent to wheel 122 which is attached thereto by screw or bolt 128 threaded into wheel hub 122H, and the other part of the "L" adjacent and attached to platform 110 by fasteners 118, e.g., screws or bolts 118, nuts 119 and washers 117. Typically, two fasteners 128 are employed for attaching each mounting bracket 126 to platform 110, however, a greater or lesser number may be employed. In a preferred arrangement, mounting brackets 126 are disposed adjacent the bottom surface 114 of platform 110 so that the longitudinal axis of wheel 122 may be located between the top and bottom surfaces 113, 114 of platform 110 or near to top surface 113 thereof, depending upon the location of the hole in brackets 126 through which fasteners 128 pass, as is preferred for a center wheel 122.

For an outboard wheel 124, the described arrangement maybe employed with the location of the hole in brackets 126 through which fasteners 128 pass being further removed from the substantially right angle bend of "L" shaped mounting bracket 126, to locate the central axis of rotation of outboard wheel 124 further above top surface 113 than is the axis of rotation of center wheel 122, as is preferred for an outboard wheel 124. Further, and alternatively, different wheel diameters and/or axle locations may be utilized to similar effect a desired relative location for wheels 122, 124.

While the illustrated arrangement is thought to be preferred for providing a stronger support for platform 110 on wheels 122, 124, 132, 134, and for supporting the weight and impact force generated by a rider on top surface 113 of platform 110, wheel mounting brackets 126 could be mounted with one part of the "L" adjacent the top surface 113 of platform 110 and with the other part of the "L" extending downwardly through the opening in platform 110.

While it is thought to be preferred that the axis of rotation of center wheel 122 be above the bottom surface 114 of platform 110, e.g., between surfaces 113 and 114 of platform, or near top surface 113 thereof, and that the axes of rotation of outboard wheels 124 be further above the bottom surface 114 of platform 110 than that of center wheel 113, it is acceptable that the axes of rotation of all of wheels 122, 124 be above top surface 113 of platform 110 so long as the axes of rotation of outboard wheels 124 are further above top surface 113 than is the axis of rotation of center wheel 122, e.g., for wheels 122, 124 of similar diameter. Further, and alternatively, different wheel diameters and/or axle locations may be utilized to similar effect a desired relative location for wheels 122, 124 with their respective axles located at or above the bottom surface 114 of platform 110.

Figure 7:
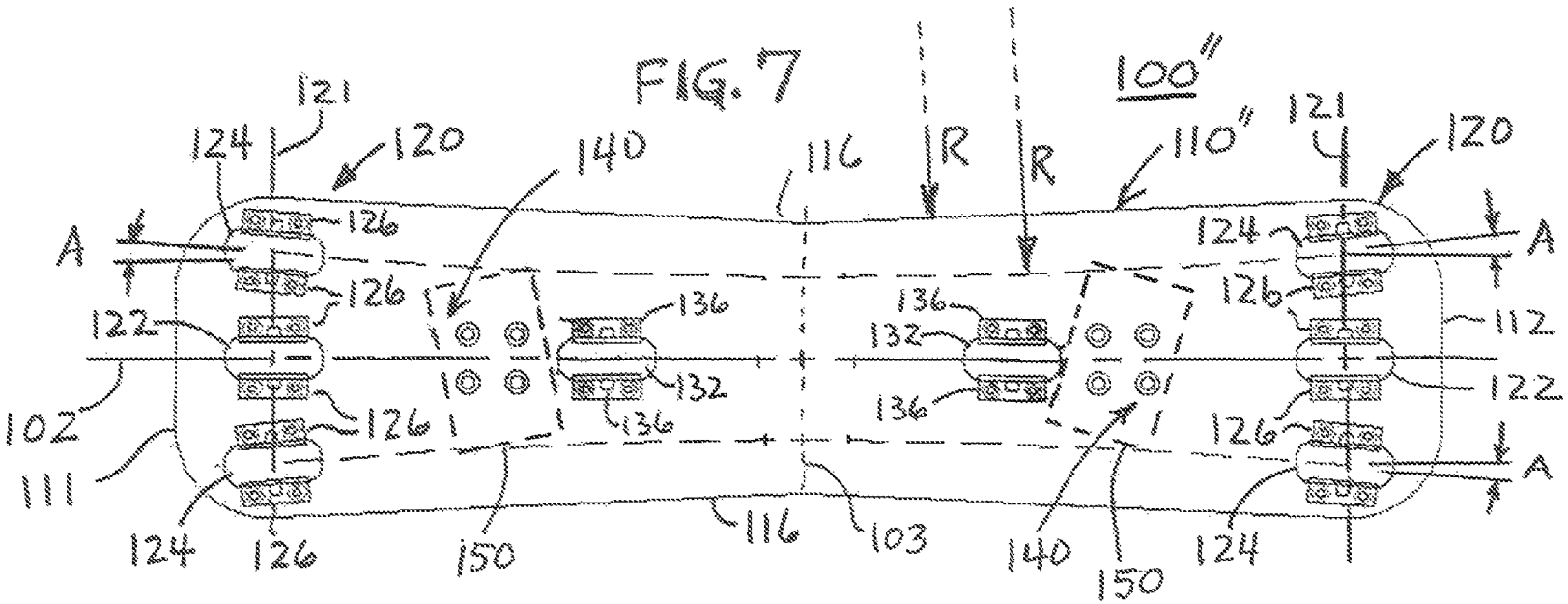
FIG. 7 is a schematic diagram top view of an example embodiment of a wheeled sport apparatus in a shape simulating a snowboard.
Figure 8:
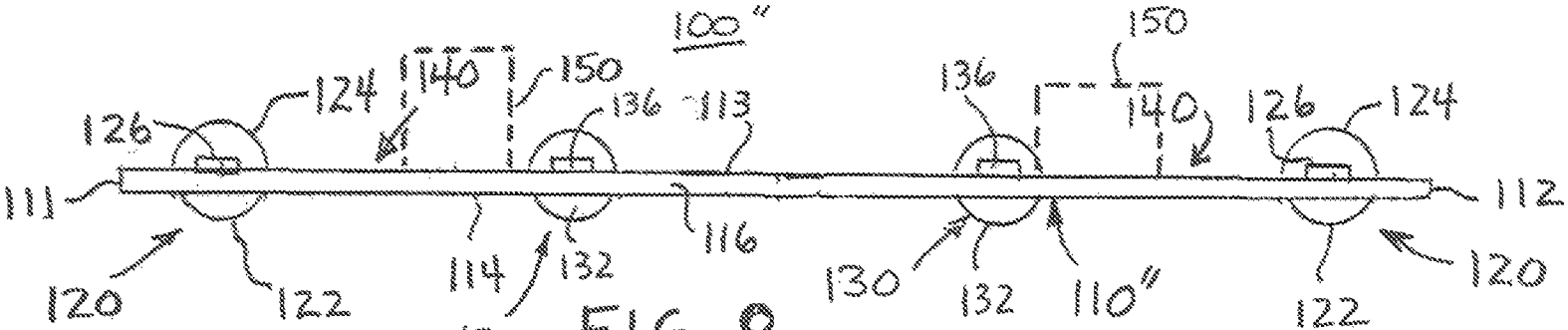
FIG. 8 is a schematic diagram side view of the example embodiment of a wheeled sport apparatus in a shape simulating the snowboard of FIG. 7.

FIGS. 7 and 8 are schematic diagrams in top view and in side view, respectively, of an example embodiment of a wheeled sport apparatus 100" in a shape simulating a snowboard. The wheeled apparatus snowboard 100" may be the same as the wheeled apparatus snowboard 100 described above except that in place of the carrier wheel or wheels 130, 132 and/or 134 located at the longitudinal center 103 of platform 110, two carrier wheels 130, 132 are located both fore and aft of the center 103 of platform 110" of apparatus 110". Fore and aft carrier wheels 132 are preferably located at positions generally under or close to the locations at which the feet of a rider would be placed, thereby to more directly support the weight of the rider and the impact loads associated with the landing and riding of apparatus 100". Fore and aft carrier wheels 132 are aligned to roll in a direction generally parallel to the longitudinal centerline or axis 102 of apparatus 100", e.g., in a typical direction of travel.

Fore and aft carrier wheels 132 are typically similar to the wheels and the attachment thereof through openings in platform 110" as described above in relation to apparatus 100. Because of the location of carrier wheels 132, the binding mounts 140 of a platform 110" may have fewer binding mount points or threaded inserts than a platform 110. The end wheels 122, 124, the mountings 126 thereof, the bindings 150 and attachments 140 therefor, are like those described above.

As with apparatus 100, the balance and turning of apparatus 110" are accomplished by the outboard wheels 124 as the rider leans in the direction of a turn and as platform 110" flexes under the weight and loads associated therewith. As the rider leans into a turn, platform 110" flexes so that apparatus 110" rides on the fore and aft outboard wheels 124 that are the inside wheels of the turn. This arrangement typically allows for a skilled rider to make tighter turns than the angular geometry of the wheels 124 alone would indicate. For example, where the outboard wheels 124 are canted or toed out at an angle A to define a turning circle having a radius R of about 8 m, a skilled rider may be able to make a turn as tight as about 4 m.

Figure 9:
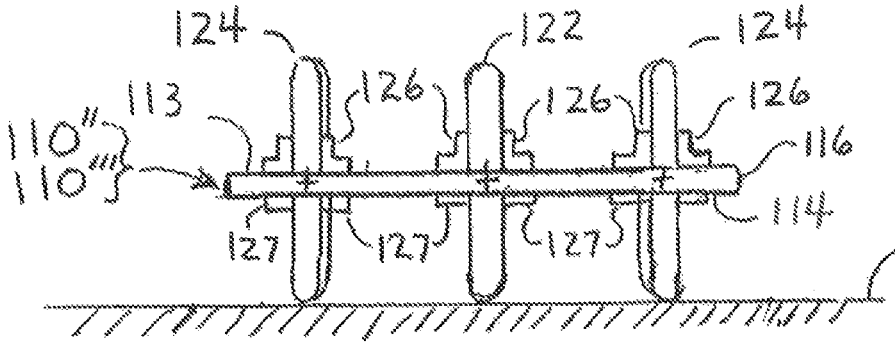
FIG. 9 is a schematic diagram end view of an example embodiment of a wheeled sport apparatus.

FIG. 9 is a schematic diagram end view of an example embodiment of a wheeled sport apparatus 100". Therein, center wheel 122 is positioned at about the same elevation relative to platform 110" as are outboard wheels 124. Where carrier wheels 132 are located generally under a rider's feet so as to bear the weight of the rider relatively directly, there is less weight supported by the end wheels 120 and so forward and aft wheels 120 tend to exhibit less friction with the surface on which apparatus 100" rolls.

As a result, when turning apparatus 100", center wheels 122 can remain in contact with the surface being ridden on without interfering with the riding characteristics of apparatus 100" and may even provide turning characteristics that are improved over the extended center wheel 122 arrangement described above, at least in some configurations of apparatus 100". Alternatively, a wheel 120 mounting arrangement as shown in FIG. 6 may also be employed.

The wheels of fore and aft wheel sets 120 are mounted in openings in platform 110" with parts of the wheels thereof above platform 110" and parts of the wheels below platform 110" so that platform 110" rides closer to a riding surface, thereby to be more like as now board on snow or a ski on snow, similarly to the arrangement of apparatus 100, 100'. Wheel mounting arrangements as in FIG. 6 or suitable alternatives thereto may be employed. The axis of rotation of each of wheels 120, 122, 124, 130, 132 is above, i.e. further away from the surface on which apparatus 100" rolls, than is the bottom surface 114 of platform 110".

Figure 11:
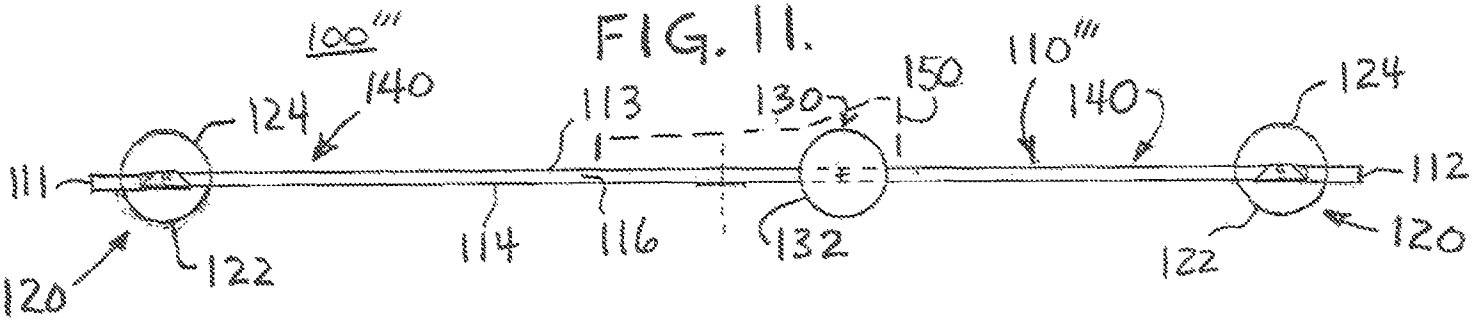
FIG. 11 is a schematic diagram side view of the example embodiment of a wheeled sport apparatus in a shape simulating the ski of FIG. 9.
Figure 10:
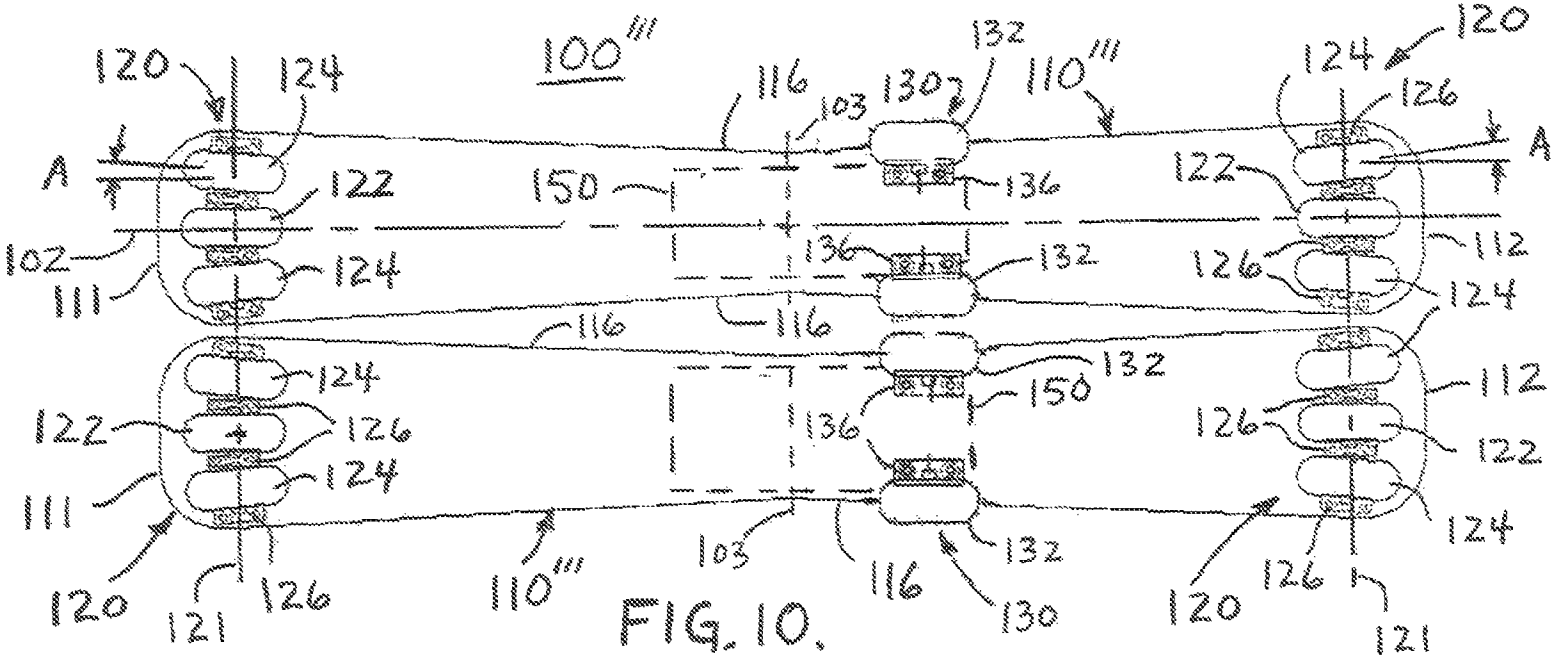
FIG. 10 is a schematic diagram top view of an example embodiment of a wheeled sport apparatus in a shape simulating skis.

FIGS. 10 and 11 are schematic diagrams in top view and in side view, respectively, of an example embodiment of a wheeled sport apparatus 100'" in a shape simulating a ski, generally similar in size and shape and configuration to apparatus 100' described above. Each ski 100'" has a set 120 of three wheels 122, 124 located at the forward and aft ends of platform 110'" of wheeled sport apparatus 100'" and has a pair of carrier wheels 132 with one carrier wheel 132 located proximate each edge 116 of apparatus 100'" and aft of the center 103 thereof between opposite ends 111, 112 thereof With outboard wheels 130 located at the edges of platform 110'" and aft of the longitudinal center 103 thereof, all of the wheels 120, 122, 124, 130, 132 of apparatus 100'" may be at the same elevation relative to platform 110'" with their respective axes of rotation positioned at an elevation above the bottom surface of platform 110'''. Carrier wheels 132 are preferably positioned aft of the center 103 of platform 110''', i.e. closer to aft end 112 than to forward end 111, in locations that are approximately under the heel of the boot binding 150 which is located on the top surface of platform 110'''.

As a result, the support provided by wheels 132 is preferably approximately under the ankles of a rider using ski apparatus 100''' which tends to make it easier and more natural for the rider to lean forward when using apparatus 100''' rather than leaning backward. Leaning forward is necessary for proper balance when skiing on snow skis, and so this configuration of skiing apparatus 100''' may more closely simulate snow skis. Leaning backwards while skiing almost always leads to loss of balance and to falling backwards.

Outboard carrier wheels 132 located at the edges 116 of skis 100''' may be at the edges 116 thereof or may be slightly outboard of the edges 116 thereof. For example, wheels 132 maybe further outboard than the edge 116 of platform 110''' by about one-half the width of the wheel 132. Thus, for a wheel 132 having a 24 mm wide contact surface, wheel 132 may be cantilevered about 12 mm outboard of edge 116. In all other respects, wheeled ski apparatus 100''' maybe the same as apparatus 100, 100' as described above.

Figure 12:
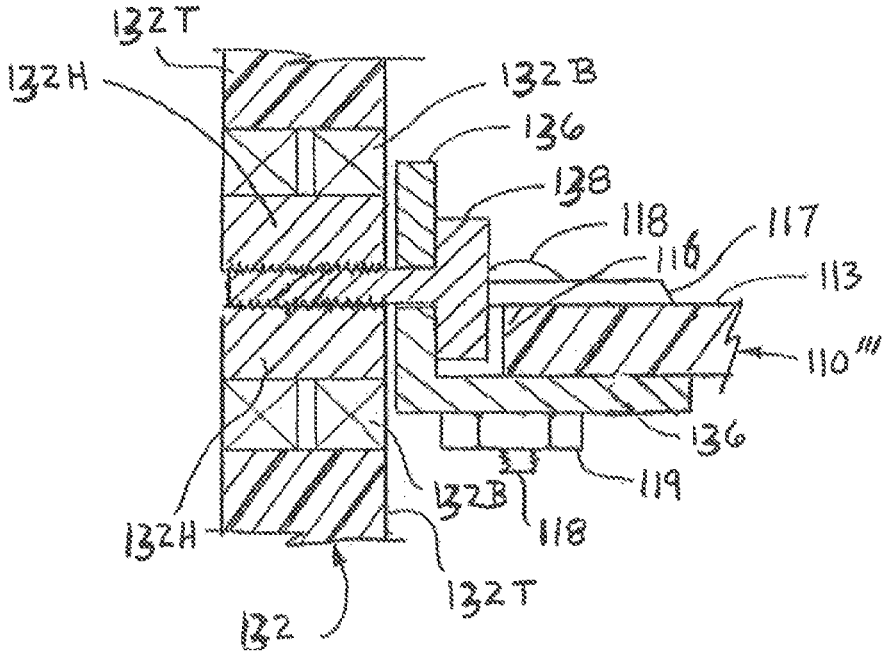
FIG. 12 is a schematic diagram cross-sectional view of an example mounting arrangement for a wheel of a wheeled sport apparatus.

FIG. 12 is a schematic diagram cross-sectional view of an example mounting arrangement for a wheel 132 of a wheeled sport apparatus 100''' wherein the wheel 132 is mounted at or near an edge 116 of platform 110'''. Wheel 132 located at edge 116 of platform 110''' is typically cantilevered outward from a mounting structure similar to half of the structure illustrated in FIG. 6, for example. Wheel 136 includes a wheel hub 132H having a threaded central hole with hub 132H being surrounded by bearings 132B for supporting and allowing free rotation of wheel tire portion 132T around an axis of rotation that is substantially coaxial with the central axis of the threaded hole through hub 132H and fastener 138 therein.

With that mounting structure, for example, a cantilevered mounting of a wheel 132 would employ one mounting bracket 136, one mounting fastener 138 threaded into hub 132H of the wheel, and one set of fasteners and washers 117, 118, 119. Since only one side of the arrangement shown in FIG. 6 is employed, the proportions may be different than shown in relation to FIG. 6, e.g., such as to have a larger bearing area and washer 117 for clamping mounting bracket 136 to platform 110. Alternatively, bracket 136 could have a threaded hole therein into which mounting fastener 138 would thread or mounting fastener 138 could be a longer screw or bolt 138 that would extend beyond the outboard side of wheel hub 132H and have a nut (not shown) thereon, e.g., to serve as a lock nut.

It should be noted that in addition to the side wheels 132 of the example embodiment 100''' of FIGS. 10-11, cantilevered wheel mounting may be employed for any of the outboard and/or side wheels in other embodiments, e.g., outboard wheels 124 and/or optional carrier wheels 134 of wheeled snowboard apparatus 100, outboard wheels 124 of wheeled ski apparatus 100', outboard wheels 124 of wheeled snowboard apparatus 100'' and/or outboard wheels 124 and/or side carrier wheels 132 of wheeled snowboard apparatus 100'''.

Wheeled sport apparatus 100, 100', 100'', 100''' may comprise: a platform 110, 110', 110'', 110''' having first and second ends 111, 112 and first and second side edges 116, having a top riding surface 113 and a bottom surface 114, and having a longitudinal axis 102 along its length substantially centrally between the first and second side edges 116; a first set of three wheels 120 for rolling in a direction generally parallel to the longitudinal axis 102 and located proximate the first end 113 of platform 110, 110', 110'', 110''' in spaced apart relationship generally along a line 121 that is substantially perpendicular to the longitudinal axis 102 of platform 110, 110', 110'', 110''', wherein each of first set of three wheels 120 is disposed in an opening in platform 110, 110', 110'', 110''' wherein a center one of first set of three wheels 120 is a center wheel 122 located substantially on the longitudinal axis 102 and wherein the other two of the first set of three wheels 120 are outboard wheels 124 disposed outboard of the center wheel 122 with the center wheel 122 therebetween, wherein each of first set of three wheels 120 extends above the top riding surface 113 of platform 110, 110', 110'', 110''', and wherein the center wheel 122 extends further from the bottom surface 114 of platform 110, 110', 110'', 110''' than do the two outboard wheels 124; and a second set of three wheels 120 for rolling in a direction generally parallel to the longitudinal axis 102 and located proximate the second end 112 of platform 110, 110', 110'', 110''' in spaced apart relationship generally along a line 121 that is substantially perpendicular to the longitudinal axis 102 of platform 110, 110', 110'', 110''', wherein each of second set of three wheels 120 is disposed in an opening in platform 110, 110', 110'', 110''', wherein a center one of second set of three wheels is a center Wheel 122 located substantially on the longitudinal axis 102 and wherein the other two of second set of three wheels 120 are outboard wheels 124 disposed outboard of the center wheel 122 with the center wheel 122 therebetween, wherein each of second set of three wheels 120 extends above the top riding surface 113 of platform 110, 110', 110'', 110''', and wherein the center wheel 122 extends further from the bottom surface 114 of platform 110, 110', 110'', 110''' than do the two outboard wheels 124. Each of the outboard wheels 124 may be toed outward at an angle A for defining a turning radius R. The turning radius R may be between about four meters and about fifteen meters, or may be about five meters. The first and second side edges 116 may define a curve having a radius of about the turning radius R. The axis of rotation of the center wheel 122 maybe above the bottom surface of platform 110, 110', 110'', 110'''. The axis of rotation of the center wheel 122 may be between the top riding 113 and bottom surfaces 114 of platform 110, 110', 110'', 110''' and the axes of rotation of the outboard wheels 124 may be above the top standing surface 113 of platform 110, 110', 110'', 110'''. The axes of rotation of the outboard wheels 124 may be above the top standing surface 113 of platform 110, 110', 110'', 110'''. Wheeled sport apparatus 100, 100', 100'', 100''' may further comprise at least one carrier wheel 130 located on platform 110, 110', 110'', 110''' between first set of wheels 120 and second set of wheels 120. Wheeled sport apparatus 100, 100', 100'', 100''' may further comprise a mounting arrangement 140 for a receiving foot restraining device 150 on the top riding surface 113 of platform 110, 110', 110'', 110'''; or; a foot restraining device 150 affixed to the top riding surface 113 of platform 110, 110', 110'', 110'''; or a mounting arrangement 140 on the top riding surface 113 of platform 110, 110', 110'', 110''' and a foot restraining device 150 affixed thereto.

Wheeled sport apparatus 100, 100', 100'', 100''' may comprise: a platform 110, 110', 110'', 110''' having first and second ends 111, 112 and first and second side edges 116, having a top riding surface 113 and a bottom surface 114, and having a longitudinal axis 102 along its length substantially centrally between the first and second side edges 102; first and second sets of wheels 120, 120 for rolling in a direction generally parallel to the longitudinal axis 102 and located in respective openings in platform 110, 110', 110'', 110''' proximate the first and second ends 111, 112, respectively, of platform 110, 110', 110'', 110''' in spaced apart relationship generally along a line 121 that is substantially perpendicular to the longitudinal axis 102 of platform 110, 110', 110", 110'", wherein two wheels 124 of each of first and second sets of wheels 120, 120 are outboard wheels 124 disposed at a toed out angle A outboard of a center wheel 122 thereof with the center wheel 122 therebetween and located substantially on the longitudinal axis 102, wherein each wheel of first and second sets of wheels 120, 120 extends above the top riding surface 113 of platform 110, 110', 110", 110'" and wherein the center wheel 122 of each of first and second sets of wheels 120, 120 extends further from the bottom surface 114 of platform 110, 110', 110", 110'" than do the two outboard wheels 124 thereof.

Wheeled sport apparatus 100, 100', 100", 100'" may comprise: a platform 110, 110', 110", 110'" having first and second ends 111, 112 and first and second side edges 116, having a top riding surface 113 and a bottom surface 114, and having a longitudinal axis 102 along its length substantially centrally between the first and second side edges 116; a first set of three wheels 120 for rolling in a direction generally parallel to the longitudinal axis 102 and located proximate the first end I11 of the platform 110, 110', 110", 110'" in spaced apart relationship generally along a line 121 that is substantially perpendicular to the longitudinal axis 102 of the platform 110, 110', 110", 110'", wherein a center one of the first set of three wheels 120 is a center wheel 122 located substantially on the longitudinal axis 102 and wherein the other two of the first set of three wheels 120 are outboard wheels 124 disposed outboard of the center wheel 122 with the center wheel 122 therebetween, wherein at least the center wheel 122 of the first set of three wheels is disposed in an opening in the platform 110, 110', 110", 110'", wherein each wheel 122, 124 of the first set of three wheels 120 extends above the top riding surface 113 of the platform 110, 110', 110", 110'" and below the bottom surface 114 of the platform 110, 110', 110", 110'", and wherein each of the outboard wheels 124 is toed outward at an angle for defining a turning radius; and a second set of three wheels 120 for rolling in a direction generally parallel to the longitudinal axis 102 and located proximate the second end 112 of the platform 110, 110', 110", 110'" in spaced apart relationship generally along a line 121 that is substantially perpendicular to the longitudinal axis 102 of the platform 110, 110', 110",
110'", wherein a center one of the second set of three wheels 120 is a center wheel 122 located substantially on the longitudinal axis 102 and wherein the other two of the second set of three wheels 120 are outboard wheels 124 disposed outboard of the center wheel 122 with the center wheel 122 therebetween, wherein at least the center wheel 122 of the second set of three wheels is disposed in an opening in the platform 110, 110', 110", 110'", wherein each wheel 122, 124 of the second set of three wheels 120 extends above the top riding surface 113 of the platform 110, 110', 110", 110'" and below the bottom surface 114 of the platform 110, 110', 110", 110'", and wherein each of the outboard wheels 124 is toed outward at the angle for the defined turning radius. The center wheel 122 of each of the first and second sets of three wheels 120 may extend further from the bottom surface 114 of the platform 110, 110', 110", 110'" than do the two outboard wheels 124 thereof. The turning radius may be: between about four meters and about fifteen meters, or may be about eight meters, or may be about five meters. Each of the first and second side edges 116 of the platform 110, 110', 110", 110'" may define a concave curve having a radius of about the turning radius. The axes of rotation of the center wheels 122 and of the outboard wheels 124 may be above the bottom surface 114 of the platform 110, 110', 110", 110'". The axis of rotation of the center wheel 122 may be between the top riding surface 113 and the bottom surface 114 of the platform 110, 110', 110", 110'" and the axes of rotation of the outboard wheels 124 may be above the top riding surface 113 of the platform 110, 110', 110", 110'". The wheeled sport apparatus 100, 100', 100", 100'" may further comprise: at least one carrier wheel 130 located on the platform 110, 110', 110", 110'" between the first set of three wheels 120 and the second set of three wheels 120. The wheeled sport apparatus 100, 100', 00", 100'" may further comprise: at least first and second carrier wheels 132 located on the platform 110, 110', 110", 110'" between the first set of three wheels 120 and the second set of three wheels 120, wherein the first carrier wheel 132 is closer to the first set of three wheels 120 than to the second set of three wheels 120 and wherein the second carrier wheel 132 is closer to the second set of three wheels 120 than to the first set of three wheels 120. The wheeled sport apparatus 100, 100', 100", 100'" may further comprise: at least first and second carrier wheels 132 located proximate the first and second side edges 116, respectively, of the platform 110, 110', 110", 110'" between the first set of three wheels 120 and the second set of three wheels 120, wherein the first and second carrier wheels 132 are closer to the second set of three wheels 120 than to the first set of three wheels 120. The wheeled sport apparatus 100, 100', 100", 100"" may further comprise: a mounting arrangement 140 for a receiving foot restraining device 150 on the top riding surface 113 of the platform 110, 110', 110", 110"; or afoot restraining device 150 affixed to the top riding surface 113 of the platform 110, 110', 110", 110"; or a mounting arrangement 140 on the top riding surface 113 of the platform 110, 110', 110", 110'" and a foot restraining device 150 affixed thereto.

Wheeled sport apparatus 100, 100', 100", 100'" may comprise: a platform 110, 110', 110", 110'" having first and second ends 111, 112 and first and second side edges 116, having a top riding surface 113 and a bottom surface 114, and having a longitudinal axis 102 along its length substantially centrally between the first and second side edges 116; first and second sets of wheels 120 for rolling in a direction generally parallel to the longitudinal axis 102 and located on the platform 110, 110', 110", 110'" proximate the first and second ends 111, 112, respectively, of the platform 110, 110', 110", 110'" in spaced apart relationship generally along a line 121 that is substantially perpendicular to the longitudinal axis of the platform 110, 110', 110", 110'", wherein two wheels 124 of each of the first and second sets of wheels 120 are outboard wheels 124 disposed outboard of a center wheel 122 thereof with the center wheel 122 therebetween and located substantially on the longitudinal axis 102, wherein each of the outboard wheels 124 of the first and second sets of wheels 120 is disposed at a toed out angle A defining a turning radius, and wherein each wheel of the first and second sets of wheels 120 extends above the top riding surface 113 of the platform 110, 110', 110", 110'" and below the bottom surface 114 of the platform 110, 110', 110", 110'". The center wheel 122 of each of the first and second sets of wheels 120 extends further from the bottom surface 114 of the platform 110, 110', 110", 110'" than do the two outboard wheels 124 thereof. The turning radius: may be between about four meters and about fifteen meters, or may be about eight meters, or may be about five meters. Each of the first and second side edges 116 of the platform 110, 110', 110", 110'" may define a concave curve having a radius of about the turning radius. The axes of rotation of the center wheel 122 and of the outboard wheels 124 maybe above the bottom surface 114 of the platform 110, 110', 110", 110'". The axis of rotation of the center wheel 122 may be between the top riding surface 113 and the bottom surface 114 of the platform 110, 110', 110", 110'" and the axes of rotation of the outboard wheels 124 maybe above the top riding surface 113 of the platform 110, 110', 110", 110'". The wheeled sport apparatus 100,100', 100", 100'" may further comprise: at least one carrier wheel 130 located on the platform 110, 110', 110", 110'" between the first set of wheels 120 and the second set of wheels 120. The wheeled sport apparatus 100, 100', 100", 100'" may further comprise: at least first and second carrier wheels 132 located on the platform 110, 110', 110", 110'" between the first set of wheels 120 and the second set of wheels 120, wherein the first carrier wheel 132 is closer to the first set of wheels 120 than to the second set of wheels 120 and the second carrier wheel is closer to the second set of wheels 120 than to the first set of wheels 120. The wheeled sport apparatus 100, 100', 100", 100'" may further comprise: at least first and second carrier wheels 132 located proximate the first and second side edges 116, respectively, of the platform 110, 110', 110", 110'" between the first set of wheels 120 and the second set of wheels 120, wherein the first and second carrier wheels 132 are closer to the second set of wheels 120 than to the first set of wheels 120. The wheeled sport apparatus 100, 100', 100", 100'" may further comprise: a mounting arrangement 140 for a receiving foot restraining device 150 on the top riding surface 113 of the platform 110, 110', 110", 110"; or a foot restraining device 150 affixed to the top riding surface 113 of the platform 110, 110', 110", 110"; or a mounting arrangement 140 on the top riding surface 113 of the platform 110, 110', 110", 110'" and a foot restraining device 150 affixed thereto.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general a dimension, size, formulation, parameter, shape or other quantity or characteristic is "about" or "approximate" whether or not expressly stated to be such. It is noted that embodiments of very different sizes, shapes and dimensions may employ the described arrangements.

Further, what is stated as being "optimum" or "deemed optimum" or "preferred" may or not be a true optimum condition, but may be the condition deemed to be "optimum" by virtue of its being selected in accordance with the decision rules and/or criteria defined by the applicable controlling function, e.g., the relative locations, axle locations, angles A, and/or materials, for wheels 122, 124, 132, 134.

While the present invention has been described in terms of the foregoing example embodiments, variations within the scope and spirit of the present invention as defined by the claims following will be apparent to those skilled in the art. For example, while the example wheels 122, 124 of example apparatus 100, 100', 100", 100'" described herein are of the same size and material, center wheels 122 could be of larger diameter than are outboard wheels 124 so as to provide a center wheel that extends further below platform 110, 110', 110", 110'" than do wheels 124 without offsetting the respective axles as described. Moreover, wheels of different materials may be utilized in an apparatus 100, 100', 100", 100'" for providing different contact characteristics with the riding surface, wheels 124 being of a different material than are wheels 122, or wheels 132, 134 being of a different material than wheels 122, 124.

While the sport apparatus herein is exemplified by embodiments particularly useful for snowboarding and skiing without snow, it may be used for other purposes including but not limited to training, recreation and or sport in itself, and may also be utilized for other snow apparatus, e.g., a toboggan or a mono-ski, and for apparatus other than snow (winter) sport apparatus, such mono or paired water skis and water ski boards.

In any embodiment, any set of wheels 120 that are located proximate an end of the platform may include three or more wheels, and any set of wheels 130 located that are located between the sets of wheels 120 located proximate the ends 113, 114 of the platform 110, 110', 110", 110'", e.g., support or carrier wheels 130, may include one or more wheels. Support or carrier wheels may be smaller wheels 132, 134 located entirely under the platform 110, or may be larger wheels 132 that extend above the riding surface and below the bottom surface of the platform when such wheels are not in an area in which the foot or feet of a rider would be placed.

Moreover, any set of wheels 120, 130 may comprise individually mounted wheels 122, 124, 132, 134 each having its own mounting bracket arrangement 126 and its own opening in platform 110, 110', 110", 110'" as illustrated, or the wheels of a set of wheels 120, 130 may be supported by a common mounting bracket arrangement and disposed through the same opening in platform 110, 110', 110", 110'".

It is noted that while directional terms such as "top," "bottom," "left" and "right," "fore" and "aft," may be used for convenience in the foregoing description, apparatus 100, 100', 100", 100'" is typically not directionally fixed or limited either in use or otherwise, and so what may be thought of as "right" at one point in a rider's ride may be "left" at another point in that ride, or the "top" surface of platform 110, 110', 110", 110'" maybe facing down or to a side, e.g., as when a rider performs a back flip maneuver wherein the rider makes one full rotation about the rider's horizontal axis or a performs a "720 rotation" maneuver wherein the rider makes a rotation of 720 degrees about the rider's vertical axis.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. Wheeled sport apparatus comprising:

a platform having first and second ends and first and second side edges, having a top riding surface and a bottom surface;

a first set of wheels located proximate the first end of said platform, wherein at least two of said first set of wheels are outboard wheels, wherein each of said first set of wheels extends above the top riding surface of said platform; and a second set of wheels located proximate the second end of said platform, wherein at least two of said second set of wheels are outboard wheels, wherein each of said second set of wheels extends above the top riding surface of said platform, and wherein each of the outboard wheels of said second set of wheels is toed outward.

2. The wheeled sport apparatus of claim 1 wherein a turning radius:

is between about four meters and about fifteen meters.

3. The wheeled sport apparatus of claim 1 wherein the axes of rotation of the outboard wheels are between the top riding surface and the bottom surface of said platform.

4. The wheeled sport apparatus of claim 1 wherein the axes of rotation of the outboard wheels are above the top riding surface of said platform.

5. The wheeled sport apparatus of claim 1 further comprising:

at least first and second carrier wheels located on said platform between said first set of wheels and said second set of wheels, wherein the first carrier wheel is closer to the first set of wheels than to the second set of wheels and wherein the second carrier wheel is closer to the second set of wheels than to the first set of wheels.

6. The wheeled sport apparatus of claim 1 further comprising:

a mounting arrangement for a receiving foot restraining device on the top riding surface of said platform.

7. The wheeled sport apparatus of claim 2 wherein each of the first and second side edges of said platform defines a concave curve having a radius of about the turning radius.

8. Wheeled sport apparatus comprising:

a platform having first and second ends and first and second side edges, having a top riding surface and a bottom surface, and having a longitudinal axis along its length substantially centrally between the first and second side edges;

first and second sets of wheels for rolling in a direction generally parallel to the longitudinal axis and located in respective openings in said platform proximate the first and second ends, respectively, of said platform, wherein each opening is distinct from each other opening, wherein the perimeter of each opening is fully enclosed by one or more of the platform and one or more mounting brackets, wherein each wheel of said first and second sets of wheels extends above the top riding surface of said platform.

9. The wheeled sport apparatus of claim 8 wherein each of the first and second side edges of said platform defines a concave curve having a radius of about a turning radius.

10. The wheeled sport apparatus of claim 8 wherein the axes of rotation of the outboard wheels are above the bottom surface of said platform and below the top riding surface of said platform.

11. The wheeled sport apparatus of claim 8 wherein the axes of rotation of the outboard wheels are above the top riding surface of said platform.

12. The wheeled sport apparatus of claim 8 further comprising:

at least first and second carrier wheels located on said platform between said first set of wheels and said second set of wheels, wherein the first carrier wheel is closer to the first set of wheels than to the second set of wheels and wherein the second carrier wheel is closer to the second set of wheels than to the first set of wheels.

13. The wheeled sport apparatus of claim 8 further comprising:

a mounting arrangement for a receiving foot restraining device on the top riding surface of said platform.

14. Wheeled sport apparatus comprising:

a platform having first and second ends and first and second side edges, having a top riding surface and a bottom surface, and having a longitudinal axis along its length substantially centrally between the first and second side edges;

a first set of wheels for rolling in a direction generally parallel to the longitudinal axis and located proximate the first end of said platform in spaced apart relationship generally along a line that is substantially perpendicular to the longitudinal axis of said platform, wherein at least two of said first set of wheels are disposed in openings in said platform;

a second set of wheels for rolling in a direction generally parallel to the longitudinal axis and located proximate the second end of said platform in spaced apart relationship generally along a line that is substantially perpendicular to the longitudinal axis of said platform, wherein at least two of said second set of wheels are disposed in openings in said platform; and at least one carrier wheel disposed between said first and second sets of wheels, wherein each wheel is disposed in a distinct opening, and wherein the entire perimeter of each opening is bounded by one or more of the platform and a mounting bracket.

15. The wheeled sport apparatus of claim 14 wherein a turning radius:

is about eight meters.

16. The wheeled sport apparatus of claim 14 wherein the axis of rotation of at least one wheel of the first set of wheels is between the top riding surface and the bottom surface of said platform.

17. The wheeled sport apparatus of claim 14 wherein the axis of rotation of at least one wheel of the first set of wheels is above the top riding surface of said platform.

18. The wheeled sport apparatus of claim 14 further comprising:

a mounting arrangement for a receiving foot restraining device on the top riding surface of said platform.

19. The wheeled sport apparatus of claim 15 wherein each of the first and second side edges of said platform defines a concave curve having a radius of about the turning radius.

20. Wheeled sport apparatus comprising:

a platform having first and second ends and first and second side edges, having a top riding surface and a bottom surface, and having a longitudinal axis along its length substantially centrally between the first and second side edges;

first and second sets of wheels located on said platform proximate the first and second ends, respectively, of said platform in spaced apart relationship, wherein two wheels of each of said first and second sets of wheels are outboard wheels having fixed rolling directions not aligned parallel to the longitudinal axis, and wherein the axes of rotation of the outboard wheels are above the bottom surface of said platform.

21. The wheeled sport apparatus of claim 20 wherein a turning radius:

is about five meters.

22. The wheeled sport apparatus of claim 20 further comprising:

at least first and second carrier wheels located on said platform between said first set of wheels and said second set of wheels, wherein the first carrier wheel is closer to the first set of wheels than to the second set of wheels and wherein the second carrier wheel is closer to the second set of wheels than to the first set of wheels.

23. The wheeled sport apparatus of claim 20 further comprising:

a mounting arrangement for a receiving foot restraining device on the top riding surface of said platform.

24. The wheeled sport apparatus of claim 21 wherein each of the first and second side edges of said platform defines a concave curve having a radius of about the turning radius.

25. Wheeled apparatus comprising:

a platform having first and second ends, a top surface and a bottom surface;

first and second sets of wheels located proximate the first and second ends, respectively, of said platform, and at least one wheel of the first and second sets of wheels being fixedly canted outward to facilitate tilting or turning of said platform and; and at least one carrier wheel disposed between said first and second sets of wheels, wherein the axes of rotation of the first and second sets of wheels are above the bottom surface of said platform.

* * * * *